US006100018A

United States Patent [19]

Tashiro

[11] Patent Number: 6,100,018

[45] Date of Patent: Aug. 8, 2000

[54] SILVER HALIDE LIGHT SENSITIVE COLOR PHOTOGRAPHIC MATERIAL

[75] Inventor: Kouji Tashiro, Hino, Japan

[73] Assignee: Konica Corporation, Tokyo, Japan

[21] Appl. No.: 09/270,018

[22] Filed: Mar. 16, 1999

[30] Foreign Application Priority Data

Mar. 19, 1998 [JP] Japan ..... 10-070324

[51] Int. Cl.[7] ..... G03C 1/46

[52] U.S. Cl. ..... 430/503; 430/362; 430/505

[58] Field of Search ..... 430/503, 362, 430/505

[56] References Cited

U.S. PATENT DOCUMENTS 4,830,954 5/1989 Matejec .
5,154,995 10/1992 Kawai .

FOREIGN PATENT DOCUMENTS 0 588 639 A1 9/1993 European Pat. Off. .
0 713 137 A2 11/1995 European Pat. Off. .
854383 7/1998 European Pat. Off. .

*Primary Examiner*—Janet Baxter
*Assistant Examiner*—Amanda Walke
*Attorney, Agent, or Firm*—Finnegan, Henderson, Farabow, Garrett & Dunner, L.L.P.

[57] ABSTRACT

A silver halide color photographic material, which is superior in color reproduction as well as its stability, is disclosed, comprising a support having thereon a blue-sensitive silver halide emulsion layer containing a yellow coupler, a green-sensitive silver halide emulsion layer containing a magenta coupler, a red-sensitive silver halide emulsion layer containing a yellow coupler, an invisible light-sensitive silver halide emulsion layer containing a coupler and a layer having an interlayer effect, which is light sensitive or light-insensitive.

9 Claims, No Drawings

SILVER HALIDE LIGHT SENSITIVE COLOR PHOTOGRAPHIC MATERIAL

FIELD OF THE INVENTION

The present invention relates to a silver halide light sensitive color photographic material with enhanced color reproducibility and in particular, to a silver halide light sensitive color photographic material in which enhanced image information and compatibility of reproduction and stability of hue are achieved.

BACKGROUND OF THE INVENTION

Since Kodachrome was put on the market by Eastman Kodak Co. in 1935. Various improvements of color photography and enhancements of photographic performance thereof have been still in progress, including fine image structure, that is, enhancements of graininess and sharpness and an enhancement of color reproduction. Of these, with regard to a technique for enhancing color reproduction, there have been marked enhancements of reproducibility in the past, including auto masking colored couplers (as described in U.S. Pat. No. 2,455,170).

The colored coupler is mainly used for enhancing color reproducibility of a color negative film. The colored coupler contributes to correction of unwanted absorption of a magenta or cyan dye. Thus, the colored coupler corrects imagewise color contamination due to unwanted absorption of produced dyes of the color negative film, enabling a marked enhancement of color reproduction. To achieve clear color reproduction, there was proposed development effect or so-called interlayer effect as a technique for enhancing color purity of the color negative film (as described in Belgian Patent 710,344 and German Patent 2,043,934). Furthermore, a DIR coupler as application of the interlayer effect was developed, whereby reproducibility of color purity was markedly enhanced (as described in U.S. Pat. No. 3,277,554).

Thus enhanced chromatic color reproduction is aimed, while there was proposed techniques to faithfully reproduce color as seen by the human eye. One of them concerns control of spectral sensitivity distribution of a blue-sensitive layer, a green-sensitive layer and a red-sensitive layer of a color film, as described in JP-A 5-150411 (hereinafter, the term, JP-A means a unexamined, published Japanese Patent Application).

There were further proposed techniques of enhancing color reproduction, in which differences in spectral sensitivity distribution between cones of the human eye and the color film was noted. The color film generally has a spectral sensitivity distribution such that a blue-sensitive layer has a sensitivity maximum at longer wavelengths, a green-sensitive layer has a sensitivity maxim at slightly longer wavelengths and a red-sensitive layer has a sensitivity maximum at rather longer wavelengths, as compared to the spectral sensitivity distribution of the human eye. Further, red cones of the eye have a region in the vicinity of 500 nm, having negative sensitivity. To allow the spectral sensitivity of the color film to meet the spectral sensitivity of the eye, the spectral sensitivity distribution by use of sensitizing dyes and the interlayer effect by use of a so-called donor layer were controlled, enabling faithful reproduction, to a certain extent, of intermediate colors, which had been hard to reproduce, as described in JP-A 61-34541.

Employing these techniques, color reproducibility of the color film enabled hue of objects to be faithfully reproduced.

As mentioned above, color reproducibility of color photography has steadily been advanced. However, it is still true that with regard to the color photographic materials of the next generation, further enhancement of color reproducibility having different aspects is still desired. The reason for this is that amateur photographers are often still disappointed when they receive their prints. Cited as disappointments are often, when photographing fresh green woods, red flowers and distant mountain ranges. There are numerous photographers, when they have taken such pictures and receive the processed prints, the resulting prints are different from their expectation or from what they had in mind, in which the fresh green color of woods shows dark and dull tones, the fine details of petals of the red flowers is lost, leading to so-called red saturation, and the distant mountain ranges appear to be veiled in mist, losing the three dimensional realism in which they were originally viewed.

Thus, color photography is not satisfactory simply with faithfulness and clearness in color reproduction but it also requires excellent image rendering, which vividly reproduce the scene being photographed.

Japanese Patent Application No. 9-179656 discloses a technique of providing an infrared sensitive layer, information of which was added to visible images to enhance the information amount, enhancing reproduction of a specified color. Although the information amount was thereby markedly enhanced and color reproduction of green leaves was improved, it was also proved that color stability was still unacceptable level. When a red flower was photographed, for example, this infrared sensitive layer was allowed to be photo-sensitized to not only the green leaves but also red petals. It was therefore proved that when the infrared sensitive layer contained a magenta coupler, color reproduction of the red flower was deteriorated and when a cyan coupler was contained therein, color reproduction of the green leaves was deteriorated. It was further proved that when both couplers were contained, both color reproductions were deteriorated. Japanese Patent Application No. 9-8672 discloses a silver halide photographic material, characterized in the photographic material containing a compound having a spectral sensitivity maximum at the wavelengths of 680 to 730 nm and capable of releasing a development inhibitor or its precursor. The object of this disclosure is mainly directed to providing of the interlayer effect of a red sensitive layer to an infrared sensitive and not to an improvement of a specific color reproduction when the infrared sensitive layer is converted to visible images.

SUMMARY OF THE INVENTION

An object of the present invention is to provide a silver halide light sensitive color photographic material with superior scene rendering, and particularly, a silver halide color photographic material enhanced in the amount of information such as greenish woods and color reproduction thereof, and superior in color reproduction stability.

The above object of the invention can be accomplished by the following constitution:

1. a silver halide light sensitive color photographic material comprising a support having on one side thereof a blue-sensitive silver halide emulsion layer containing a yellow coupler, a green-sensitive silver halide emulsion layer containing a magenta coupler, a red-sensitive silver halide emulsion layer containing a cyan coupler and an invisible light-sensitive silver halide emulsion layer containing a coupler, and further having a layer providing an interlayer effect;
2. the silver halide color photographic material described above, characterized in that the layer having an interlayer effect contains a compound selected from the group consisting of a DIR compound and a colored coupler;

3. the silver halide color photographic material described in above item 1 or 2, characterized in that the layer having an interlayer effect is an invisible light-sensitive silver halide emulsion layer;
4. the silver halide color photographic material described in above item 3, characterized in that the invisible light-sensitive silver halide emulsion layer having an interlayer effect is different in spectral sensitivity from the invisible-light sensitive silver halide emulsion layer containing a coupler;
5. the silver halide color photographic material described in above item 1 or 2, characterized in that the layer having an interlayer effect is light-insensitive;
6. the silver halide color photographic material described in any one of above items 1 to 5, characterized in that the layer having an interlayer effect has its interlayer effect to at least one of the invisible light-sensitive silver halide emulsion layer containing a coupler and the red-sensitive silver halide emulsion layer;
7. the silver halide color photographic material described in any one of above items 1 to 6, characterized in that the layer having an interlayer effect is between the red-sensitive silver halide emulsion layer and the invisible light-sensitive silver halide emulsion layer;
8. the silver halide color photographic material described in item 7, characterized in that that the layer having an interlayer effect is between the red-sensitive silver halide emulsion layer and the invisible light-sensitive silver halide emulsion layer, and is adjacent to the red-sensitive silver halide emulsion layer and the invisible light-sensitive silver halide emulsion layer;
9. the silver halide color photographic material described in any one of items 1 to 4 and items 6 to 8, characterized in that the invisible light-sensitive silver halide emulsion layer is an infrared-sensitive silver halide emulsion layer;
10. a silver halide light sensitive color photographic material having at least five light sensitive layers each having a spectral sensitivity different from the others;
11. the silver halide color photographic material described in item 10, characterized in that photographic material has at least five light sensitive layers each having a spectral sensitivity different from the others, and the five light sensitive layers each are light-sensitive at the wavelengths longer than the other in the order of approaching to a support;
12. the silver halide color photographic material described in item 10 or 11, characterized in that at least one of the light-sensitive layers contains an invisible light-sensitive silver halide emulsion; and
13. a method for enhancing color reproduction by the use of the silver halide color photographic material described in any one of items 1 to 12.

DETAILED DESCRIPTION OF THE INVENTION

In one of embodiments of the present invention, a photographic material has at least five light sensitive layers each having a spectral sensitivity different from the others.

As described above, Japanese Patent Application 9-179656 discloses a photographic material having four light sensitive layers each having a spectral sensitivity different from the others, which were comprised of a blue-sensitive layer, green-sensitive layer, red-sensitive layer and a invisible light-sensitive layer. However, the expected effects were not achieved in this photographic material. Thereafter, as a result of the studies, it was found that in addition to the four light sensitive layer described above, arrangement of one more layer having a different spectral sensitivity led to solving the problems.

In this invention, light sensitive layers each having a spectral sensitivity different from the others, means that with respect to spectral sensitivity distribution of each light sensitive layer, the sensitivity region having a sensitivity of not less than 50% of the sensitivity maximum of each of the light sensitive layers does not overlap with that of the other light sensitive layers. In other words, the sensitivity regions having a sensitivity of not less than 50% of the sensitivity maximum of the light sensitive layers do not overlap with each other. Therefore, the expression "at least five light sensitive layers each having a spectral sensitivity different from the others" means, as defined above, at least five light sensitive layers having different sensitivity. Further, the expression "a high-speed light sensitive layer (upper layer), intermediate-speed light sensitive layer (intermediate layer) and low-speed light sensitive layer (lower layer) within the same light sensitive layer" means plural layers of the same spectral sensitivity and having different speeds, and therefore is to be a single light sensitive layer (spectral-sensitive layer).

Sensitivity of a silver halide emulsion contained in the light sensitive layer according to the invention is at least one-hundredth of the sensitivity of a silver halide emulsion having the highest sensitivity among silver halide emulsion (s) contained in the photographic material. In cases where plural kinds of silver halide emulsions are contained in a single light sensitive layer, difference in spectral sensitivity is judged in light of spectral sensitivities of all of these silver halide emulsions.

The invisible light-sensitive layer containing a coupler according to the invention refers to a silver halide emulsion having a sensitivity maximum at a wavelength except for the visible (light) region of 400 to 680 nm. In the invention, invisible light reflected from a picture-taken material is employed into a photographic image and the invisible light-sensitive layer substantially plays a role of achieving this. The coupler contained in the invisible light-sensitive layer is optimally selected, depending on photo subject. In cases when green leaves (or woods) is the photo subject, for example, the invisible light-sensitive layer preferably has the sensitivity maximum within the infrared region and the coupler to be contained is preferably a magenta coupler.

Red flowers exhibit reflection within the wavelengths of 600 to 680 nm and most of them further are reflective within the infrared region. Green leaves exhibit reflection at wavelengths of not less than 720 nm. In cases when taking pictures of both red flowers and green leaves with a photographic material having an invisible light-sensitive layer having a sensitivity maximum with the infrared region and containing a magenta coupler, the invisible light-sensitive layer brings about an increase of information. As a result, the green leaves are reproduced with clearer green. On the other hand, as the invisible light-sensitive layer also is sensitive to the red flowers, the photographed flowers become greenish. To make correction thereof was provided a layer having an interlayer effect, as one embodiment of the invention. Herein, the layer having an interlayer effect (or an interlayer effect-having layer) is a layer exerting its interlayer effect on another layer. Thus, the interlayer effect-having layer is a layer having the function of lowering the density of the other layer, and preferably one inhibiting color formation of another layer in relation to exposure or one forming an image with a color of another layer in inverse relation to exposure. Examples of the former include a layer containing a DIR compound which is capable of releasing a development inhibitor or its precursor upon reaction with an oxidation product. Examples of the latter include a layer containing a colored coupler. Preferred examples of the DIR compound include a DIR coupler capable of releasing a development inhibitor or its precursor upon coupling reaction with an oxidation product DIR substance loping agent and a DIR substance capable of releasing a development inhibitor or its precursor upon cross-oxidation with an oxidation product of a developing agent. The interlayer effect-having layer may be a light sensitive silver halide emulsion layer or a layer which does not contain any light sensitive silver halide emulsion, so-called a light-insensitive layer. In cases of the light sensitive silver halide emulsion layer, this emulsion layer inhibits color formation of another layer in relation to exposure given to the emulsion layer, or forms an image with a color of another layer, in inverse relation to exposure given to the emulsion layer. In cases of the light-insensitive layer, inhibition of color formation or image formation described above is subject to an oxidation product of a developing agent which has been produced in a neighboring, light sensitive silver halide emulsion layer in relation to exposure and diffused therefrom.

A case will be further explained, in which the same scene as described above is photographed by the use of a photographic material including an invisible light-sensitive layer containing a coupler and an invisible light-sensitive layer having an interlayer effect. If spectral sensitivity of one of these two invisible light-sensitive layers overlaps with that of the other, effects of both layers are cancelled out and a region in which overlapping is as low as possible is preferred. Furthermore, to enhance green color reproduction as an advantage of the invisible light-sensitive layer containing a coupler, it is preferable that spectral sensitivity distribution of the interlayer effect-having layer does not overlap with the reflection spectrum of chlorophyll. Therefore, the invisible light-sensitive layer containing a coupler preferably has a sensitivity maximum at wavelengths of 680 to 850 nm, and more preferably 730 to 780 nm. The invisible light-sensitive layer having interlayer effect preferably has a sensitivity maximum at the wavelengths of not less than 660 to 750 nm, more preferably 680 to 750 nm, and still more preferably 680 to 720 nm.

Effects of the invention are supposed to be exhibited as follows. This interlayer effect-having layer has spectral sensitivity within the region of 680 to 720 nm, which is not needed in conventional red color reproduction and is close to near infrared absorption of the red flowers and in which reflection of the green leaves is so low that the effect on green color reproduction is minimal. Therefore, the interlayer effect-having layer functions only onto the red flowers, inhibiting color formation of the invisible light-sensitive layer containing a coupler. As a result, the green color of the green leaves is more clearly reproduced and no failure of red color of the red flowers occurs due to the interlayer effect. Further, the interlayer effect of the interlayer-having layer on the red-sensitive layer also occurs, leading to increased saturation of the red color and improvements in red color reproduction and flesh tone stability.

Another embodiment of the invention is further described with respect to photographing the same scene as described above with a photographic material in which a light-insensitive layer containing a DIR compound and/or colored coupler is provided between the red-sensitive layer and the invisible light-sensitive layer containing a coupler. In this case, green color is clearly reproduced due to the invisible light-sensitive layer containing a coupler. Regarding the red flower, excessive oxidation products of developing agent are diffused to reach the adjacent invisible light-sensitive layer containing a coupler and inhibit color formation therein, leading to improved red color reproduction.

It is supposed that the present invention achieved enhancement of color reproduction and its stability, based on the mechanism described above.

The coupler containing, invisible light-sensitive layer used in the invention has the sensitivity maximum at the wavelengths except for 400 to 680 nm, and a sensitizing dye preferably used therein is represented by the following formula [I-a] or [I-b]:

Formula [I-a]

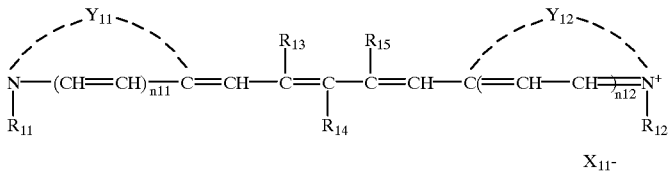

Formula [I-b]

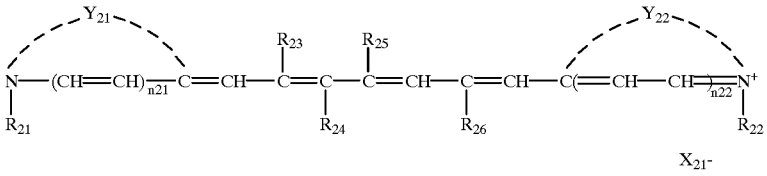

wherein $Y_{11}$, $Y_{12}$, $Y_{21}$ and $Y_{22}$ each represent a non-metallic atom group necessary for forming a 5- or 6-membered nitrogen-containing heterocyclic ring, including, e.g., a benzothiazole ring, a naphthothiazole ring, a benzoselenazole ring, a naphthoselenazole ring, a benzooxazole ring, a naphthooxazole ring, a quinoline ring, a 3,3-dialkylindolenine ring, a benzimidazole ring and a pyridine ring. These heterocyclic rings may be substituted by a lower alkyl group, a lower alkoxy group, a hydroxy group, an aryl group, an alkoxycarbonyl group or a halogen atom. $R_{11}$, $R_{12}$, $R_{21}$ and $R_{22}$ each represent a substituted or unsubstituted alkyl, aryl, or aralkyl group. $R_{13}$, $R_{14}$, $R_{23}$, $R_{24}$, $R_{25}$ and $R_{26}$ each represent a hydrogen atom, an alkyl group, an alkoxy group, a phenyl group, a benzyl group, ech of which may be substituted, or $-NW_1(W_2)$, in which W1 and W2 each represent a substituted or unsubstituted alkyl group (having 1 to 18 carbon atoms and preferably 1 to 4 carbon atoms) or aryl group, provided that $W_1$ and $W_2$ may be linked with eact other to form a 5- or 6-membered nitrogen-containing heterocyclic ring. $R_{13}$ and $R_{15}$, or $R_{23}$ and $R_{25}$ may be linked with each other to form a 5- or 6-membered nitrogen-containing heterocyclic ring. $X_1^-$ and $X_{21}^{31}$ each represent an anion; $n_{11}$, $n_{12}$, $n_{21}$ and $n_{22}$ are each 0 or 1.

Examples of the compound represented by formula [I-a] or [I-b] include Compounds A-1 through A-14 and No.13 described in JP-A 7-13289. These sensitizing dyes may be used singly or in combination. Specifically, combination of the sensitizing dyes is often employed for the purpose of supersensitization. Along with the sensitizing dye may be contained a dye having no spectral sensitizing capability or a substance which does not substantially absorb visible light. Usable sensitizing dyes, combination of dyes exhibiting supersensitization and super-sensitizing substances are described in Research Disclosure vol.176, 17643 (1978, December) page 23, sect.IV-J; JP-B 49-25500 and 43-4938 (herein, the term, JP-B means an examined, published Japanese Patent); JP-A 59-19032, 59-192242, 3-15049 and 62-123454. The sensitizing dye described above is contained in an amount of $1\times10^{-7}$ to $1\times10^{-2}$, and preferably $1\times10^{-6}$ to $5\times10^{-3}$ mol per mol of silver halide.

Exemplary examples of the dye represented by formula [I-a] or [I-b] are shown below, but the dye is not limited to these examples.

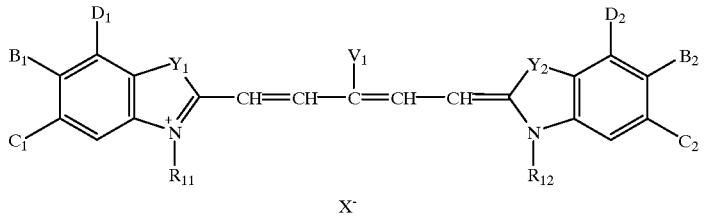

| Compd. No. | $Y_1$ | $Y_2$ | $B_1$ | $C_1$ | $B_2$ | $C_2$ | $R_{11}$ | $R_{12}$ | $V_1$ | $X^-$ | $D_1$ | $D_2$ |
|---|---|---|---|---|---|---|---|---|---|---|---|---|
| 1-1 | Se | Se | H | H | H | H | $C_2H_5$ | $C_2H_5$ | H | I | H | H |
| 1-2 | S | S | H | H | H | H | $C_2H_5$ | $C_2H_5$ | H | I | H | H |
| 1-3 | Se | Se | H | H | H | H | $(CH_2)_2OCH_3$ | $(CH_2)_2OCH_3$ | H | Br | H | H |
| 1-4 | Se | S | H | H | H | H | $(CH_2)_3SO_3H$ | $C_2H_5$ | H | — | H | H |
| 1-5 | S | S | H | $OCH_3$ | H | H | $C_2H_5$ | $C_2H_4OH$ | $C_2H_5$ | Br | H | H |
| 1-6 | S | S | $C_2H_5$ | H | $C_2H_5$ | H | $C_5H_{11}$ | $C_5H_{11}$ | $C_2H_5$ | Br | H | H |
| 1-7 | S | S | $C_2H_5$ | H | $C_2H_5$ | H | $C_5H_{11}$ | $C_5H_{11}$ | $C_4H_9$ | Br | H | H |
| 1-8 | S | S | $OCH_3$ | $OCH_3$ | $OCH_3$ | $OCH_3$ | $C_2H_5$ | $C_2H_5$ | $CH_3$ | I | H | H |
| 1-9 | S | S | $OCH_3$ | H | $OCH_3$ | H | $C_2H_5$ | $C_2H_5$ | H | I | $OCH_3$ | $OCH_3$ |
| 1-10 | S | S | $OCH_3$ | H | $OCH_3$ | H | $CH_2CH{=}CH_2$ | $CH_2CH{=}CH_2$ | H | I | $OCH_3$ | $OCH_3$ |
| 1-11 | S | S | $OCH_3$ | H | $OCH_3$ | H | $CH_2CH{=}CH_2$ | $CH_2CH{=}CH_2$ | $C_2H_5$ | Br | $OCH_3$ | $OCH_3$ |

1-12

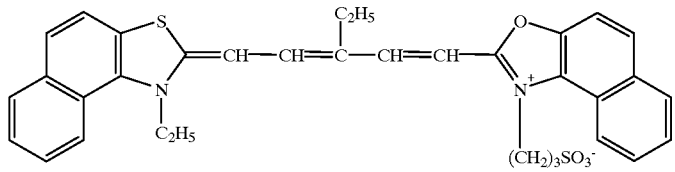

1-13

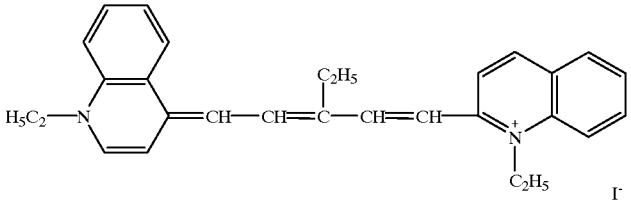

1-14

-continued

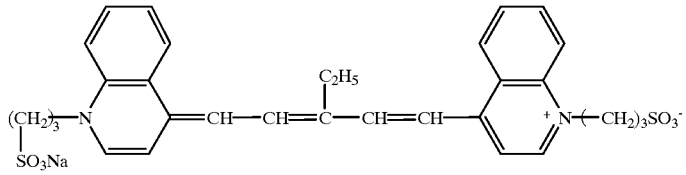

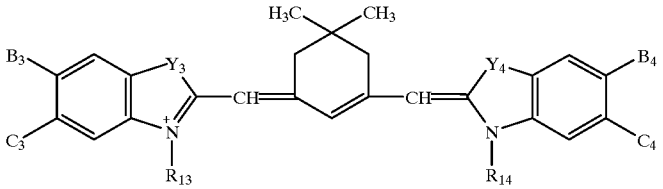

$X^-$

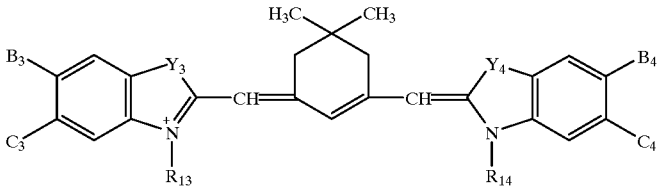

$X^-$

| Comp. No. | $Y_3$ | $Y_4$ | $B_3$ | $C_3$ | $B_4$ | $C_4$ | $R_{13}$ | $R_{14}$ | $X^-$ |
|---|---|---|---|---|---|---|---|---|---|
| 2-1 | S | S | H | H | H | H | $C_2H_5$ | $C_2H_5$ | Br |
| 2-2 | S | S | $CH_3$ | Cl | H | Cl | $C_2H_5$ | $C_2H_5$ | Br |
| 2-3 | S | S | $CH_3$ | H | $CH_3$ | H | $C_2H_5$ | $C_2H_5$ | I |
| 2-4 | S | S | H | Cl | H | Cl | $C_2H_5$ | $C_2H_5$ | Br |
| 2-5 | S | S | H | H | H | H | $C_2H_5$ | $C_4H_9$ | I |
| 2-6 | S | S | H | H | H | H | $C_2H_5$ | $C_5H_{11}$ | Br |
| 2-7 | S | S | H | H | H | H | $C_2H_5$ | $C_7H_{15}$ | Br |
| 2-8 | S | S | H | H | H | H | $C_2H_5$ | $C_{10}H_{21}$ | Br |
| 2-9 | S | S | H | H | H | H | $C_3H_7$ | $C_3H_7$ | Br |
| 2-10 | S | S | H | H | H | H | $C_4H_9$ | $C_4H_9$ | $PTS^{-}$* |
| 2-11 | S | S | H | H | H | H | $C_5H_{11}$ | $C_5H_{11}$ | Br |
| 2-12 | S | S | H | H | H | H | $C_7H_{15}$ | $C_7H_{15}$ | Br |
| 2-13 | S | S | $CH_3$ | H | H | H | $C_2H_5$ | $C_5H_{11}$ | Br |
| 2-14 | S | S | $CH_3$ | H | $CH_3$ | H | $C_2H_5$ | $C_5H_{11}$ | Br |
| 2-15 | S | S | $OCH_3$ | H | H | H | $C_2H_5$ | $C_2H_5$ | Br |
| 2-16 | S | S | $OCH_3$ | H | H | H | $C_2H_5$ | $C_5H_{11}$ | Br |
| 2-17 | S | S | $CH_3$ | $CH_3$ | $CH_3$ | $CH_3$ | $C_2H_5$ | $C_2H_5$ | Br |
| 2-18 | S | S | $C_3H_7$(i) | H | $C_3H_7$(i) | H | $C_2H_5$ | $C_2H_5$ | Br |
| 2-19 | S | S | H | H | H | H | $C_2H_5$ | $(CH_2)_3SO_3^-$ | — |
| 2-20 | S | S | $CH_3$ | H | $CH_3$ | H | $C_2H_5$ | $(CH_2)_4SO_3^-$ | — |
| 2-21 | S | S | $CH_3$ | H | $CH_3$ | H | $(CH_2)_3SO_3HN(C_2H_5)_3$ | $(CH_2)_3SO_3^-$ | — |
| 2-22 | S | S | H | H | H | H | $C_2H_5$ | $(CH_2)_4SO_3^-$ | — |
| 2-23 | S | S | H | $CH_3$ | H | $CH_3$ | $C_2H_5$ | $C_5H_{11}$ | Br |
| 2-24 | Se | Se | H | H | H | H | $C_2H_5$ | $C_2H_5$ | Br |
| 2-25 | Se | Se | $CH_3$ | H | $CH_3$ | H | $C_2H_5$ | $C_2H_5$ | Br |

*PTS: p-toluenesulfonic acid 2-26

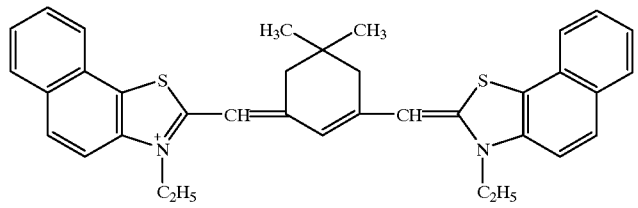

$I^-$ 2-27

-continued
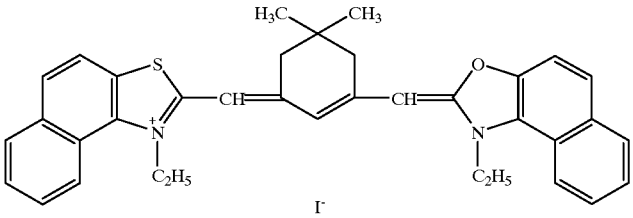
3-1
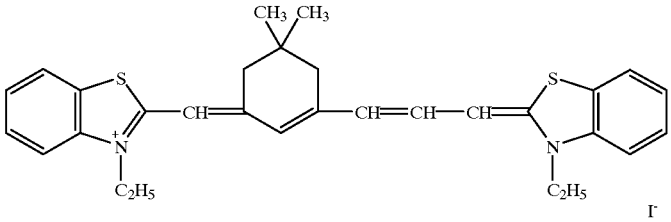
3-2
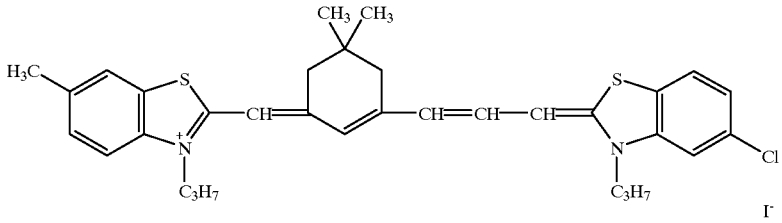
3-3
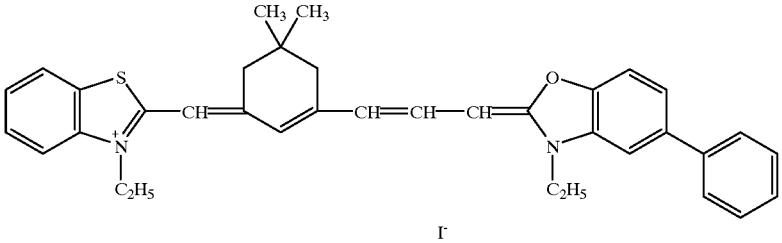
3-4
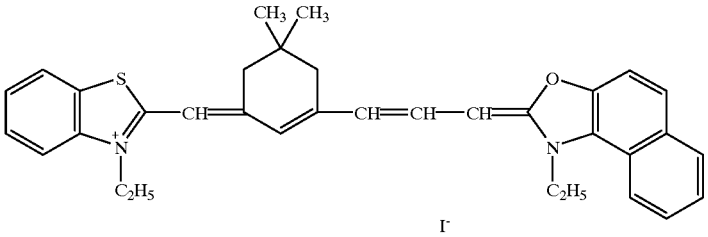
3-5
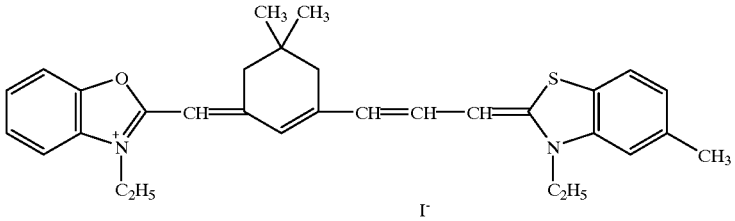
3-6

-continued
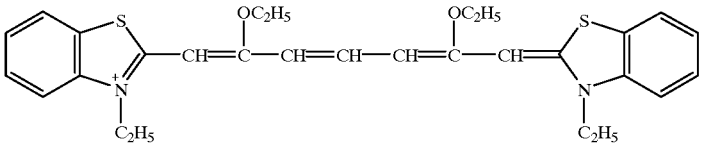
$I^-$
3-7
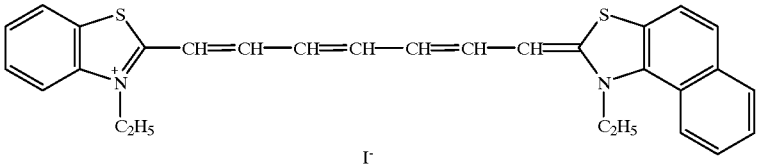
$I^-$
3-8
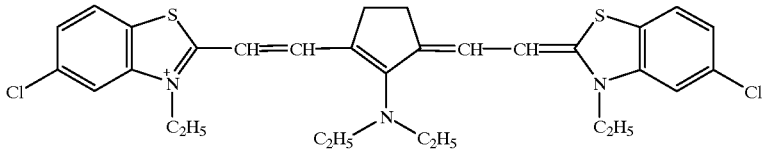
$ClCO_4^-$
3-9
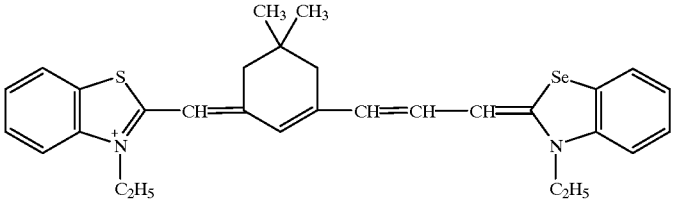
$I^-$
3-10
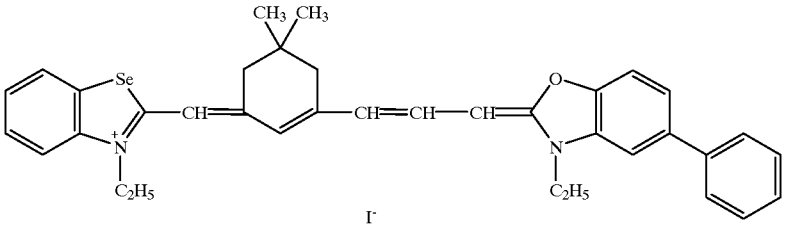
$I^-$
3-11
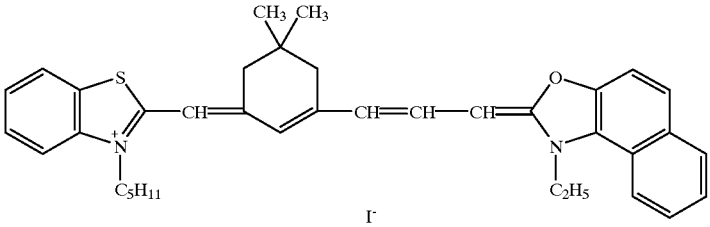
$I^-$
3-12

-continued
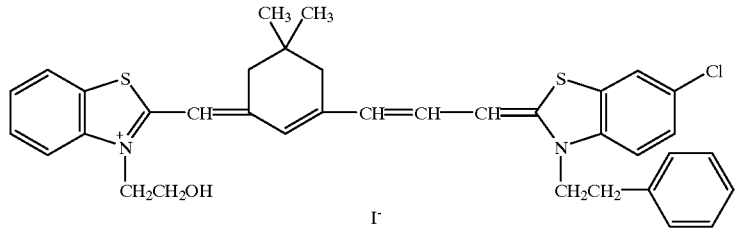
3-13
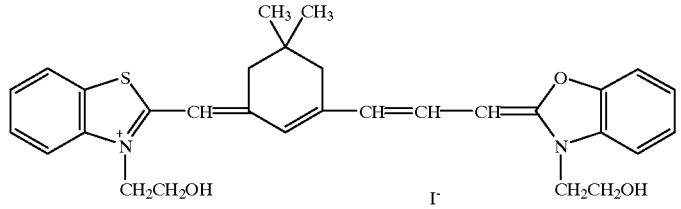
3-14
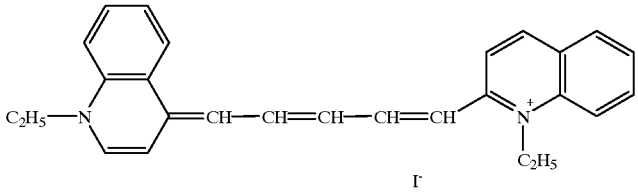
3-15
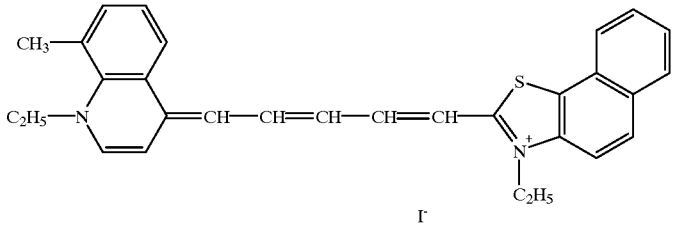
3-16
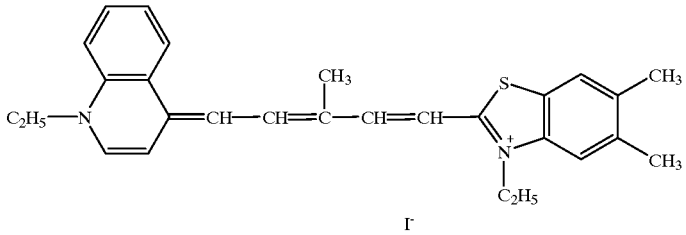
3-17
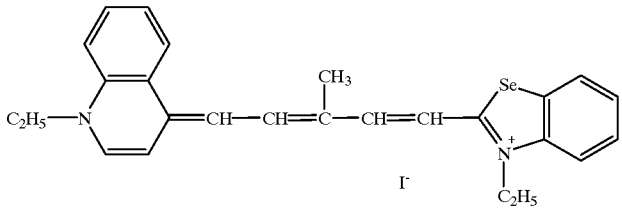
3-18

-continued

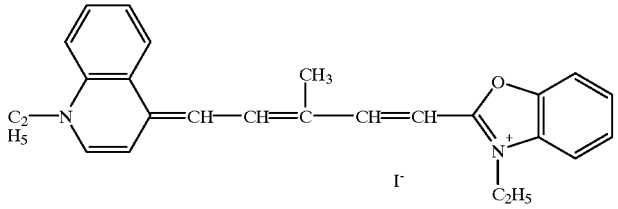

3-19

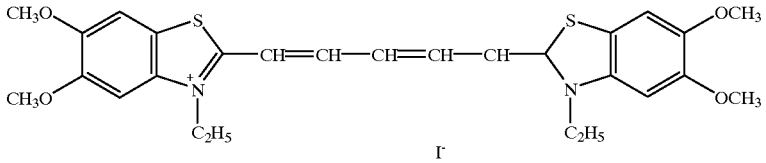

3-20

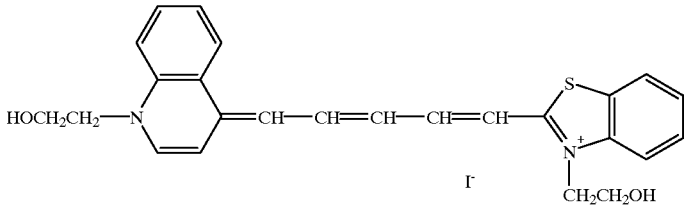

3-21

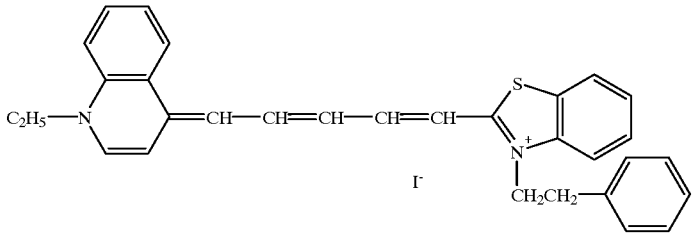

The dyes described above can be readily synthesized, for example, according to the method described in F. M. Hammer, The Chemistry of Heterocyclic Compounds vol. 18, "The Cyanine Dyes and Related Compounds (A. Weissberger ed., Interscience, New York, 1964).

A sensitizing dye preferably used in the invisible light-sensitive layer having an interlayer effect is represented by the following formula [II-a] or [II-b]:

Formula [II-a]

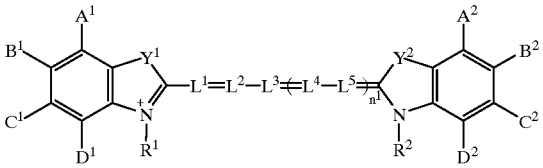

Formula [11-b]

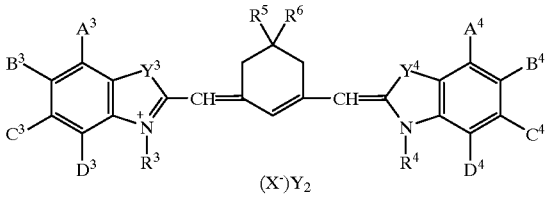

wherein $R^1$, $R^2$, $R^3$ and $R^4$ each represent an alkyl group, alkenyl group of aryl group; $L^1$, $L^2$, $L^3$, $L^4$ and $L^5$ each are methine; $Y^1$, $Y^2$, $Y^3$ and $Y^4$ each represent a oxygen atom, sulfur atom or selenium atom; $A^1$, $A^2$, $A^3$, $A^4$, $B^1$, $B^2$, $B^3$, $B^4$, $C^1$, $C^2$, $C^3$, $C^4$, $D^1$, $D^2$, $D^3$ and $D^4$ each represent a hydrogen atom, halogen atom, alkyl group, alkoxy group, phenyl group, cyano, nitro, or alkoxycarbonyl group, provided that at least one of combinations of $A^1$ and $B^1$, $B^1$ and $C^1$, $C^1$ and $D^1$, $A^2$ and $B^2$, $B^2$ and $C^2$, $C^2$ and $D^2$, $A^3$ and $B^3$, $B^3$ and $C^3$, $C^3$ and $D^3$, $A^4$ and $B^4$, $B^4$ and $C^4$, and $C^4$ and $D^4$ is combined with each other to form a benzene ring; $R^5$ and $R^5$ each represent an alkyl group; $n^1$ is 0 or 1; $X^{31}$ represents an anion; and $Y_1$ and $Y_2$ each are 0 or 1, provided that when intramolecular salt is formed, $Y_1$ and $Y_2$ are 0. In the formulas, [II-a] and [II-b], the alkyl group represented by $R^1$, $R^2$, $R^3$ and $R^4$ may be brached and is preferably one having 10 or less carbon atoms, which may be substituted. Examples of a substituent include sulfo, aryl, carboxy, alkoxy, aryloxy, hydroxy, alkoxycarbonylacyloxy, acyl, aminocarbonyl, and cyano groups and a halogen atom. Examples of the alkyl group include methyl, ethyl, propyl, butyl, pentyl, hexyl, heptyl, sulfoethyl, sulfopropyl, sulfobutyl, benzyl, phenethyl, carboxyethyl, carboxymethyl, dimethylaminopropyl, methoxyethyl, phenoxypropyl, methylsulfonylethyl, p-t-butylphenoxyethyl, octyl, decyl, carbamoylethyl, sulfophenethyl, sulfobenzyl, 2-hydroxy3-sulfopropyl, ethoxycarbonylethyl, 2,3-disulfopropoxypropyl, sulfopropoxyethylethyl, trifluoroethyl, carboxybenzyl, cyanopropyl, p-carboxyphenethyl, ethoxycarbonylmethyl, pivaloylpropyl, propionylethyl, anicyl, acetoxyethyl, benzoyloxypropyl, chloroethyl, morpholinoethyl, acetylaminoethyl, N-ethylaminocarbonylpropyl, and cyanoethyl.

The alkenyl group is preferably one having 10 or less carbon atoms, including allyl, 2-butenyl and 2-propinyl.

Examples of the aryl group include phenyl, carboxyphenyl and sulfophenyl. The methine group represented by $L^1$, $L^2$, $L^3$, $L^4$ and $L^5$ of the formulas [II-a} and [II-b] may be substituted. In case of having a substituent, it is represented by formula: —$CR_5$═, in which $R_a$ is preferably a straight-chained or branched alkyl group with 1 to 8 carbon atoms (e.g., methyl, ethyl, propyl, butyl, carboxyl, benzyl, etc.), an alkoxy group (e.g., methoxy, ethoxy, etc.) and an aryl group (e.g.,phenyl, tolyl, etc.). Examples of the anion represented by X- of formulas [II-a] and [II-b] include chloride ion, bromide ion, iodide ion, perchloride ion, fluoroborate ion, p-toluenesulfonate ion, ethylsufonate ion, methylsulfonate ion and nitrate ion. The alkyl group represented by $A^1$, $A^2$, $A^3$, $A^4$, $B^1$, $B^2$, $B^3$, $B^4$, $C^1$, $C^2$, $C^3$, $C^4$, $D^1$, $D^2$, $D^3$ and $D^4$ of formulas [II-a] and [II-b] is preferably a straight-chained or branched alkyl group with 1 to 5 carbon atoms (e.g., methyl, ethyl, propyl, butyl,trifluoromethyl, etc.), a straight-chained or branched alkoxy group with 1 to 5 carbon atoms (e.g., methoxy, ethoxy, etc.), a halogen atom of florine, chlorine, bromine and iodine atoms, a phenyl group such as phenyl and hydroxyphenyl, carboxyphenyl, and an alkoxycarbonyl group such as methoxycarbonyl and ethoxycarbonyl, and $n^1$ is 0 or 1, and preferably 1.

Exemplary examples of the sensitizing dye represented by formula [II-a] or [II-b] are shown below, but the dye is not limited to these examples.

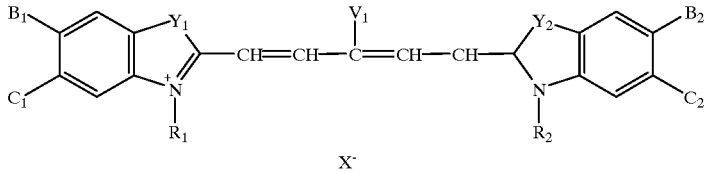

X-

| Comp. No. | $Y_1$ | $Y_2$ | $B_1$ | $C_1$ | $B_2$ | $C_2$ | $R_1$ | $R_2$ | $V_1$ | $X^-$ |
|---|---|---|---|---|---|---|---|---|---|---|
| 4-1 | Se | Se | H | H | H | H | $C_2H_5$ | $C_2H_5$ | H | I |
| 4-2 | S | S | H | H | H | H | $C_2H_5$ | $C_2H_5$ | H | I |
| 4-3 | Se | Se | H | H | H | H | $(CH_2)_2OCH_3$ | $(CH_2)_2OCH_3$ | H | Br |
| 4-4 | Se | S | H | H | H | H | $(CH_2)_3SO_3^-$ | $C_2H_5$ | H | — |
| 4-5 | S | S | H | $OCH_3$ | H | H | $C_2H_5$ | $C_2H_4OH$ | $C_2H_5$ | Br |
| 4-6 | S | S | $C_2H_5$ | H | $C_2H_5$ | H | $C_5H_{11}$ | $C_5H_{11}$ | $C_2H_5$ | Br |
| 4-7 | S | S | $C_2H_5$ | H | $C_2H_5$ | H | $C_5H_{11}$ | $C_5H_{11}$ | $C_4H_9$ | Br |
| 4-8 | S | S | $OCH_3$ | $OCH_3$ | $OCH_3$ | $OCH_3$ | $C_2H_5$ | $C_2H_5$ | $CH_3$ | I |

4-9

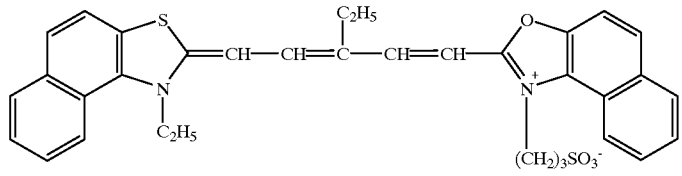

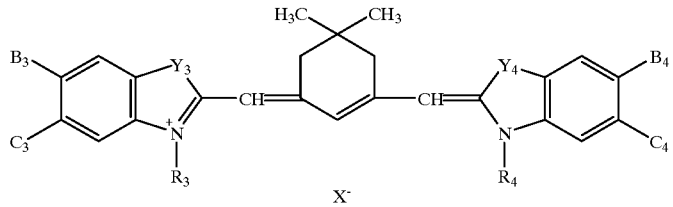

X-

| Comp. No. | $Y_3$ | $Y_4$ | $B_3$ | $C_3$ | $B_4$ | $C_4$ | $R_3$ | $R_4$ | $X^-$ |
|---|---|---|---|---|---|---|---|---|---|
| 5-1 | S | S | H | H | H | H | $C_2H_5$ | $C_2H_5$ | Br |
| 5-2 | S | S | $CH_3$ | H | H | H | $C_2H_5$ | $C_2H_5$ | Br |

-continued

| | | | | | | | | | |
|---|---|---|---|---|---|---|---|---|---|
| 5-3 | S | S | $CH_3$ | H | $CH_3$ | H | $C_2H_5$ | $C_2H_5$ | I |
| 5-4 | S | S | H | H | H | H | $C_2H_5$ | $C_3H_7$ | I |
| 5-5 | S | S | H | H | H | H | $C_2H_5$ | $C_4H_9$ | I |
| 5-6 | S | S | H | H | H | H | $C_2H_5$ | $C_5H_{11}$ | Br |
| 5-7 | S | S | H | H | H | H | $C_2H_5$ | $C_7H_{15}$ | Br |
| 5-8 | S | S | H | H | H | H | $C_2H_5$ | $C_{10}H_{21}$ | Br |
| 5-9 | S | S | H | H | H | H | $C_3H_7$ | $C_3H_7$ | Br |
| 5-10 | S | S | H | H | H | H | $C_4H_9$ | $C_4H_9$ | $PTS^{-*}$ |
| 5-11 | S | S | H | H | H | H | $C_5H_{11}$ | $C_5H_{11}$ | Br |
| 5-12 | S | S | H | H | H | H | $C_7H_{15}$ | $C_7H_{15}$ | Br |
| 5-13 | S | S | $CH_3$ | H | H | H | $C_2H_5$ | $C_5H_{11}$ | Br |
| 5-14 | S | S | $CH_3$ | H | $CH_3$ | H | $C_2H_5$ | $C_5H_{11}$ | Br |
| 5-15 | S | S | $OCH_3$ | H | H | H | $C_2H_5$ | $C_2H_5$ | Br |
| 5-16 | S | S | $OCH_3$ | H | H | H | $C_2H_5$ | $C_5H_{11}$ | Br |
| 5-17 | S | S | $CH_3$ | $CH_3$ | $CH_3$ | $CH_3$ | $C_2H_5$ | $C_2H_5$ | Br |
| 5-18 | S | S | $C_3H_7$(i) | H | $C_3H_7$(i) | H | $C_2H_5$ | $C_2H_5$ | Br |
| 5-19 | S | S | H | H | H | H | $C_2H_5$ | $(CH_2)_3SO_3^-$ | — |
| 5-20 | S | S | $CH_3$ | H | $CH_3$ | H | $C_2H_5$ | $(CH_2)_4SO_3^-$ | — |
| 5-21 | S | S | $CH_3$ | H | $CH_3$ | H | $(CH_2)_3SO_3HN(C_2H_5)_3$ | $(CH_2)_3SO_3^-$ | — |
| 5-22 | S | S | H | H | H | H | $C_2H_5$ | $(CH_2)_4SO_3^-$ | — |
| 5-23 | S | S | $CH_3$ | H | $CH_3$ | H | $C_2H_5$ | $C_5H_{11}$ | Br |
| 5-24 | Se | Se | H | H | H | H | $C_2H_5$ | $C_2H_5$ | Br |
| 5-25 | Se | Se | $CH_3$ | H | $CH_3$ | H | $C_2H_5$ | $C_2H_5$ | Br |

(*PTS: p-toluenesulfonic acid)

5-26

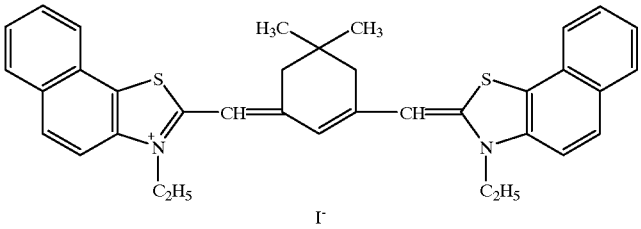

5-27

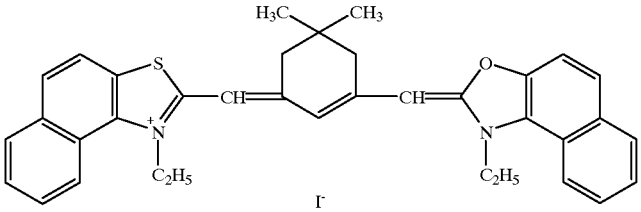

Infrared-sensitizing dyes described above can be readily synthesized in accordance with the method described in F. M. Hammer, The Chemistry of Hetrocyclic Compounds, Vol. 18, The Cyanine Dyes and Related Compounds (A. Weissberger ed. Interscience, New York), 1964).

The addition amount of the infrared-sensitizing dye used in the invention is not specifically limited, but preferably $2\times10^{-8}$ to $1\times10^{-2}$ mol per mol of silver halide.

Exemplary examples of the DIR compound include D-1 through D-34 described in JP-A 4-114153, which are preferably used in the invention. Further, examples of diffusible DIR compounds used in the invention include those described in U.S. Pat. Nos. 4,234,678, 3,227,554, 3,647,291, 3,958,993, 4,419,886 and 3,933,500; JP-A 57-56837, 51-13239; U.S. Pat. Nos. 2,072,363 and 2,070,266; and Research Disclosure , 1981, December, No. 21228.

Silver halide emulsions usable in the invention include those described in Research Disclosure No.308119 (hereinafter, denoted as RD 308119), as shown below.

| Item | RD 308119 |
|---|---|
| Iodide Composition | 993, I-A |
| Preparation Method | 993, I-A, 994 E |
| Crystal Habit (Regular crystal) | 993, I-A |
| Crystal Habit (irregular crystal) | 993, I-A |
| Epitaxial | 993, I-A |
| Halide Composition (Uniform) | 993, I-B |
| Halide Composition (Non-uniform) | 993, I-B |
| Halide Conversion | 994, I-C |
| Halide Substitution | 994, I-C |
| Metal Occlusion | 994, I-D |
| Monodisperse | 995, I-F |
| Solvent Addition | 995, I-F |
| Latent Image Formation (Surface) | 995, I-G |
| Latent Image Formation (Internal) | 995, I-G |
| Photographic Material (negative) | 995, I-H |
| Photographic Material (positive, including internally fogged grains) | 995, I-H |
| Emulsion Blend | 995, I-J |
| Emulsion Washing | 995, II-A |

The silver halide emulsion relating to the invention can be subjected to physical ripening, chemical ripening and spectral sensitization, according to the procedure known in the art. Additives used therein are described in RD 17643, RD 18716 and RD 308119, as shown below.

| Item | RD 308119 | RD 17643 | RD 18716 |
|---|---|---|---|
| Chemical Sensitizer | 996, III-A | 23 | 648 |
| Spectral Sensitizer | 996, IV-A-A, B, C, D, H, I, J | 23–24 | 648–649 |
| Super Sensitizer | 996, IV-A-E, J | 23–24 | 648–649 |
| Anti-Foggant | 998, VI | 24–25 | 649 |
| Stabilizer | 998, VI | 24–25 | 649 |

Photographic additives usable in the invention are also described in the above-described Research Disclosures, as shown below.

| Item | RD 308119 | RD 17643 | RD 18716 |
|---|---|---|---|
| Anti-staining Agent | 1002, VII-I | 25 | 650 |
| Dye Image-Stabilizer | 1001, VII-J | 25 | |
| Whitening Agent | 998, V | 24 | |
| U.V. Absorbent | 1003, VIII-I XIII-C | 25–26 | |
| Light Absorbent | 1003, VIII | 25–26 | |
| light-Scattering Agent | 1003, VIII | | |
| Filter Dye | 1003, VIII | 25–26 | |
| Binder | 1003, IX | 26 | 651 |
| Anti-Static Agent | 1006, XIII | 27 | 650 |
| Hardener | 1004, X | 26 | 651 |
| Plasticizer | 1006, XII | 27 | 650 |
| Lubricating Agent | 1006, XII | 27 | 650 |
| Surfactant Coating Aid; | 1005, XI | 26–27 | 650 |
| Matting Agent | 1007, XVI | | |
| Developing Agent (included in photographic material) | 1001, XXB | | |

A variety of couplers can be employed in the invention, exemplary examples thereof are described in the Research Disclosures, as shown below.

| Item | RD 308119 | RD 17643 |
|---|---|---|
| Yellow Coupler | 1001, VII-D | VII-C to G |
| Magenta Coupler | 1001, VII-D | VII-C to G |
| Cyan Coupler | 1001, VII-D | |
| Colored Coupler | 1002, VII-G | VII-G |
| DIR Coupler | 1001, VII-F | VII-F |
| BAR Coupler | 1002, VII-F | |
| PUG Releasing Coupler | 1001, VII-F | |
| Alkaline-soluble Coupler | 1001, VII-E | |

The additives used in the invention can be added by the dispersing method described in RD 308119 XIV. There are employed supports described in RD 17643 page 28, RD 18716 pages 647–8 and RD 308119 XIX. The photographic material relating to the invention may be provided with an auxiliary layer such as a filter layer or interlayer. as described in RD 308119 VII-K, and may have a layer arrangement, such as normal layer order, reversed layer order or unit constitution.

The silver halide light sensitive color photographic material according to the invention can be developed with a known developing agent, for example, as described in T. H. James, The Theory of The Photographic Process, Forth Edition, pages 291–334; and Journal of American Chemical Society, 73 (3) 100 (1951), and further processed according to the conventional method, as described in RD17643, pages 28–29 and RD18716 page 615 and RD308119 XIX.

EXAMPLES

The present invention is further described based on examples, but embodiments of the invention are not limited to these examples.

Example 1

The following layers having the composition described below were coated on a subbed cellulose triacetate film support in this order from the support to prepare a multi-layered color photographic material Sample 101.

In the following examples, the addition amount in the silver halide photographic material was expressed in g per $m^2$, unless otherwise noted. The coating amount of silver halide or colloidal silver was converted to silver. With respect to a sensitizing dye, it was expressed in mol per mol of silver halide contained in the same layer.

| | |
|---|---|
| 1st Layer; Antihalation Layer | |
| Black colloidal silver | 0.18 |
| UV absorbent (UV-1) | 0.30 |
| High boiling solvent (Oil-1) | 0.17 |
| Gelatin | 1.59 |
| 2nd Layer; Interlayer | |
| High boiling solvent (Oil-2) | 0.01 |
| Gelatin | 1.27 |
| 3rd layer; Low speed red-sensitive layer | |
| Silver iodobromide emulsion A | 0.80 |
| Sensitizing dye (SD-1) | $5.0 \times 10^{-5}$ |
| Sensitizing dye (SD-2) | $9.0 \times 10^{-5}$ |
| Sensitizing dye (SD-3) | $1.9 \times 10^{-5}$ |
| Sensitizing dye (SD-4) | $2.0 \times 10^{-4}$ |
| Sensitizing dye (SD-5) | $2.8 \times 10^{-4}$ |
| Cyan coupler (C-1) | 0.42 |
| Colored cyan coupler (CC-1) | 0.02 |
| High boiling solvent (Oil-1) | 0.35 |
| Gelatin | 1.02 |
| 4th Layer; Medium Speed Red-sensitive Layer | |
| Silver iodobromide emulsion E | 0.40 |
| Sensitizing dye (SD-3) | $1.8 \times 10^{-5}$ |
| Sensitizing dye (SD-4) | $2.4 \times 10^{-4}$ |
| Sensitizing dye (SD-5) | $4.5 \times 10^{-4}$ |
| Cyan coupler (C-1) | 0.26 |
| Colored cyan coupler (CC-1) | 0.05 |
| DIR compound (D-1) | 0.01 |
| High boiling solvent (Oil-1) | 0.31 |
| Gelatin | 0.78 |
| 5th Layer; High Speed Red-sensitive Layer | |
| Silver iodobromide emulsion G | 1.51 |
| Sensitizing dye (SD-3) | $1.8 \times 10^{-5}$ |
| Sensitizing dye (SD-4) | $3.1 \times 10^{-4}$ |
| Sensitizing dye (SD-5) | $2.7 \times 10^{-4}$ |
| Cyan coupler (C-2) | 0.11 |
| Colored cyan coupler (CC-1) | 0.02 |
| DIR compound (D-2) | 0.04 |
| High boiling solvent (Oil-1) | 0.17 |
| Gelatin | 1.15 |
| 6th Layer; Interlayer | |
| Yellow coupler (Y-1) | 0.02 |
| Yellow coupler (Y-2) | 0.06 |
| High boiling solvent (Oil-2) | 0.02 |
| High boiling solvent (Oil-1) | 0.17 |
| Gelatin | 0.69 |

-continued

| | |
|---|---|
| 7th Layer; Interlayer | |
| Gelatin | 0.80 |
| 8th Layer; Low Speed Green-sensitive Layer | |
| Silver iodobromide emulsion B | 0.21 |
| Sensitizing dye (SD-1) | $5.9 \times 10^{-5}$ |
| Sensitizing dye (SD-6) | $3.1 \times 10^{-4}$ |
| Sensitizing dye (SD-9) | $1.8 \times 10^{-4}$ |
| Sensitizing dye (SD-11) | $5.6 \times 10^{-5}$ |
| Magenta coupler (M-1) | 0.20 |
| Colored magenta coupler (CM-1) | 0.05 |
| DIR compound (D-1) | 0.02 |
| High boiling solvent (Oil-2) | 0.27 |
| Gelatin | 1.34 |
| 9th Layer; Medium Speed Green-sensitive Layer | |
| Silver iodobromide emulsion E | 0.82 |
| Sensitizing dye (SD-1) | $5.0 \times 10^{-5}$ |
| Sensitizing dye (SD-6) | $2.7 \times 10^{-4}$ |
| Sensitizing dye (SD-9) | $1.7 \times 10^{-4}$ |
| Sensitizing dye (SD-11) | $4.8 \times 10^{-5}$ |
| Magenta coupler (M-1) | 0.21 |
| Colored magenta coupler (CM-1) | 0.05 |
| DIR compound (D-4) | 0.02 |
| High boiling solvent (Oil-2) | 0.33 |
| Gelatin | 0.89 |
| 10th Layer; High Speed Green-sensitive Layer | |
| Silver iodobromide emulsion D | 0.99 |
| Sensitizing dye (SD-6) | $3.6 \times 10^{-4}$ |
| Sensitizing dye (SD-7) | $7.0 \times 10^{-5}$ |
| Sensitizing dye (SD-8) | $4.8 \times 10^{-5}$ |
| Sensitizing dye (SD-11) | $6.2 \times 10^{-5}$ |
| Magenta coupler (M-1) | 0.05 |
| Magenta coupler (M-2) | 0.06 |
| Colored magenta coupler (CM-2) | 0.03 |
| High boiling solvent (Oil-2) | 0.25 |
| Gelatin | 0.88 |
| 11th Layer; Interlayer | |
| High boiling solvent (Oil-1) | 0.25 |
| gelatin | 0.50 |
| 12th Layer; Yellow Filter Layer | |
| Yellow colloidal silver | 0.11 |
| Antistaining agent (SC-1) | 0.12 |
| High boiling solvent (Oil-2) | 0.16 |
| Gelatin | 1.00 |
| 13th Layer; Interlayer | |
| Gelatin | 0.36 |
| 14th Layer; Low Speed Blue-sensitive Layer | |
| Silver iodobromide emulsion B | 0.37 |
| Sensitizing dye (SD-10) | $5.6 \times 10^{-4}$ |
| Sensitizing dye (SD-11) | $2.0 \times 10^{-4}$ |
| Sensitizing dye (SD-13) | $9.8 \times 10^{-5}$ |
| Yellow coupler (Y-1) | 0.39 |
| Yellow coupler (Y-2) | 0.14 |

-continued

| | |
|---|---|
| DIR compound (D-5) | 0.03 |
| High boiling solvent (Oil-2) | 0.11 |
| Gelatin | 1.02 |
| 15th Layer; Medium Speed Blue-sensitive Layer | |
| Silver iodobromide emulsion D | 0.46 |
| Silver iodobromide emulsion F | 0.10 |
| Sensitizing dye (SD-10) | $5.3 \times 10^{-4}$ |
| Sensitizing dye (SD-11) | $1.9 \times 10^{-4}$ |
| Sensitizing dye (SD-13) | $1.1 \times 10^{-5}$ |
| Yellow coupler (Y-1) | 0.28 |
| Yellow coupler (Y-2) | 0.10 |
| DIR compound (D-5) | 0.05 |
| High boiling solvent (Oil-2) | 0.08 |
| Gelatin | 1.12 |
| 16th Layer; High Speed Blue-sensitive Layer | |
| Silver iodobromide emulsion D | 0.04 |
| Silver iodobromide emulsion G | 0.28 |
| Sensitizing dye (SD-11) | $8.4 \times 10^{-5}$ |
| Sensitizing dye (SD-12) | $2.3 \times 10^{-4}$ |
| Yellow coupler (Y-1) | 0.04 |
| Yellow coupler (Y-2) | 0.12 |
| High boiling solvent (Oil-2) | 0.03 |
| Gelatin | 0.85 |
| 17th Layer; First Protective Layer | |
| Silver iodobromide emulsion (Av. grain size of 0.04 $\mu$m, 4 mol % iodide) | 0.30 |
| UV-absorbent (UV-2) | 0.03 |
| UV absorbent (UV-3) | 0.015 |
| UV absorbent (UV-4) | 0.015 |
| UV absorbent (UV-5) | 0.015 |
| UV absorbent (UV-6) | 0.10 |
| High boiling solvent (Oil-1) | 0.44 |
| High boiling solvent (Oil-3) | 0.07 |
| Gelatin | 1.35 |
| 18th Layer; Second Protective Layer | |
| Alkali-soluble matting agent (Av. 2 $\mu$m) | 0.15 |
| Polymethylmethacrylate (Av. 3 $\mu$m) | 0.04 |
| Lubricant (WAX-1) | 0.02 |
| Gelatin | 0.54 |

In addition to the above composition were added coating aid compounds (SU-1, 2, 3 and 4), viscosity-adjusting agent (V-1), hardener (H-1 and 2), stabilizer (ST-1), fog restrainer (AF-1 and 2), AF-3 comprising two kinds of weight-averaged molecular weights of 10,000, and 1,100,000, dyes (AI-1, 2 and 3), compounds (FS-1 and 2) and antimold (DI-1).

AI-1
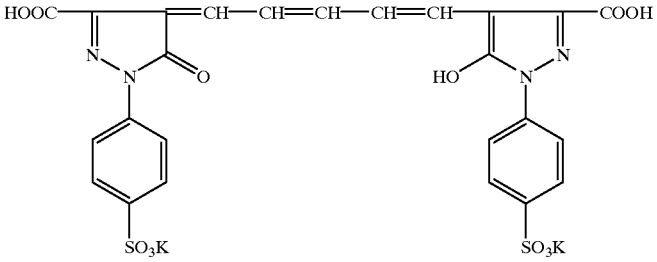
AI-2
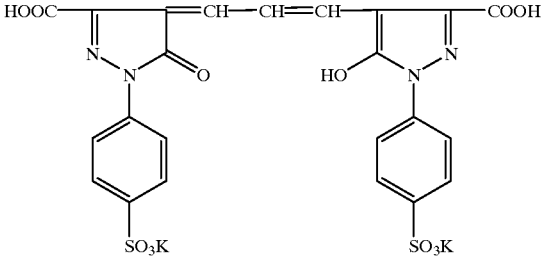
AI-3
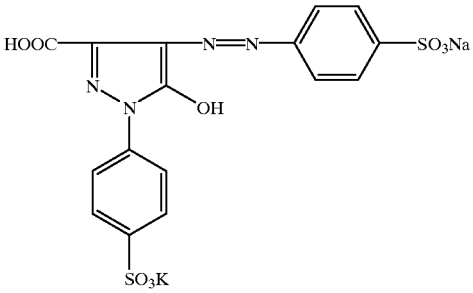
V-1
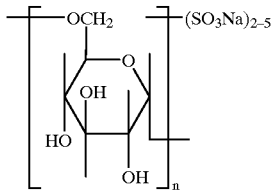
Weight-averaged molecular weight: 120,000
C-1
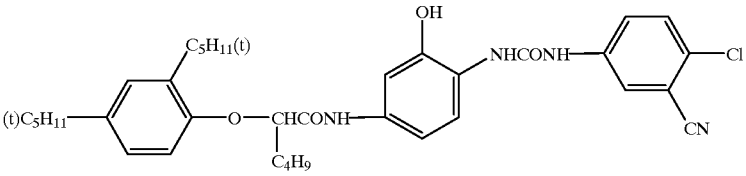
C-2
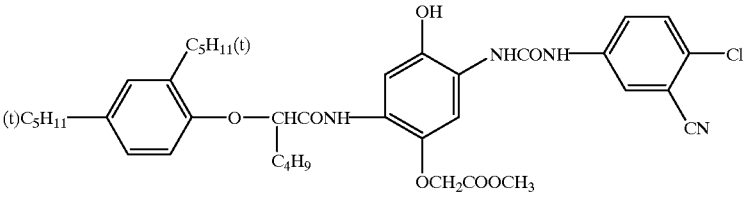

-continued
M-1
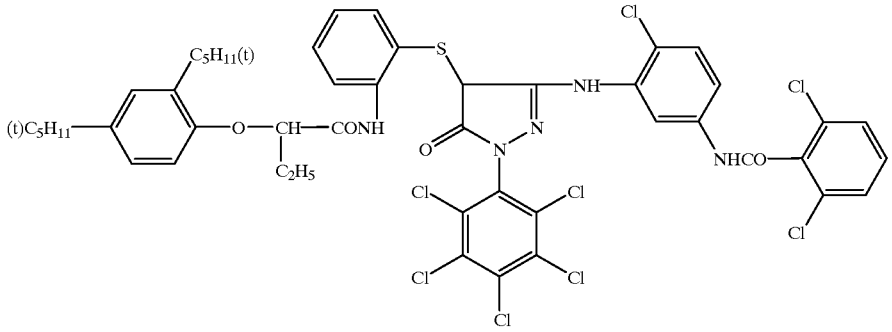
M-2
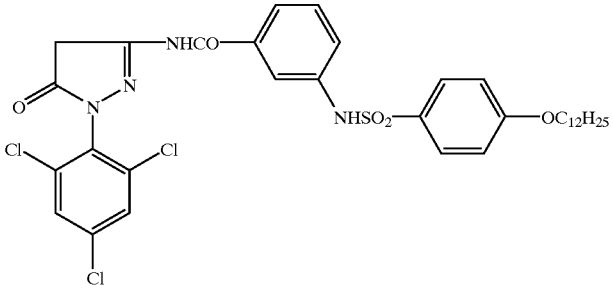
Y-1
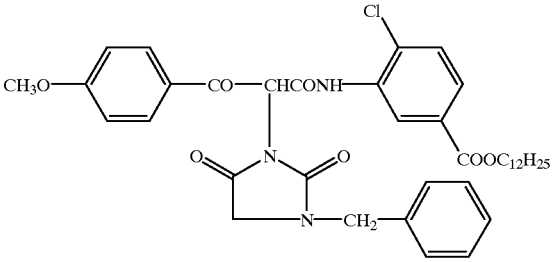
Y-2
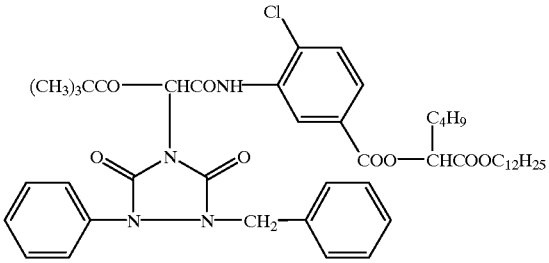
CC-1
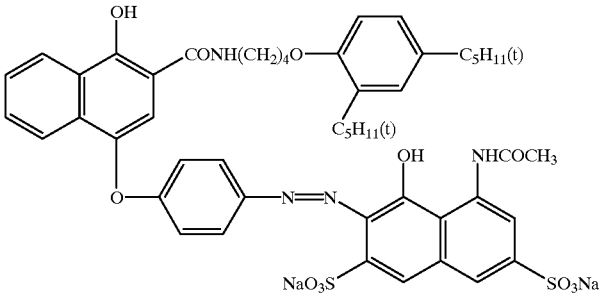

-continued
CM-1
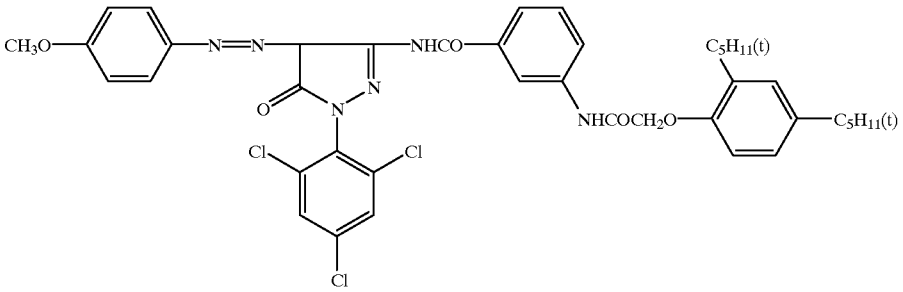
CM-2
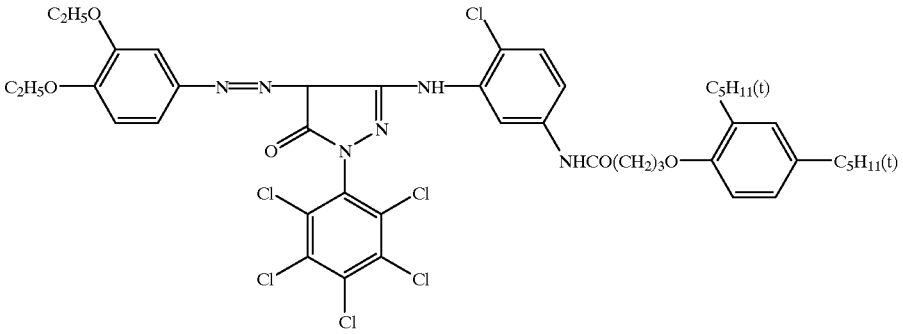
D-1
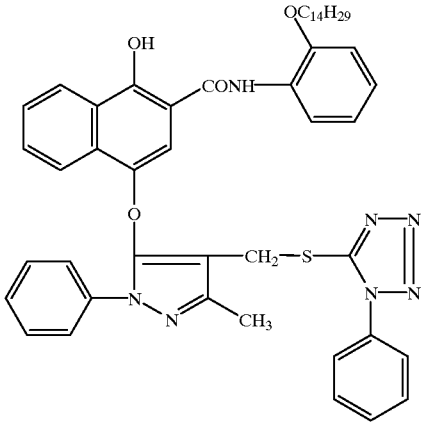
D-2
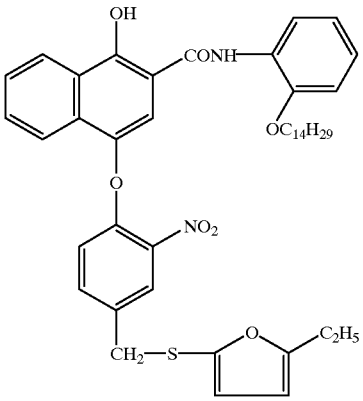

-continued
D-4
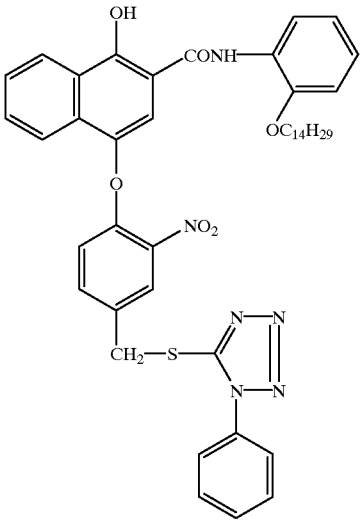
D-5
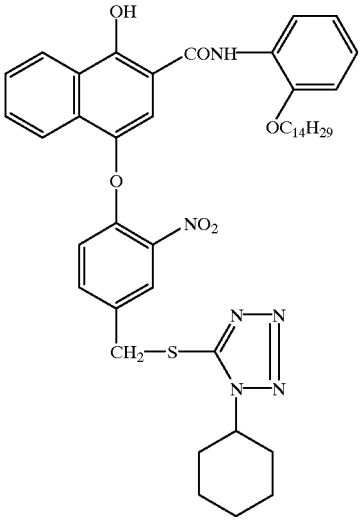
Oil-1
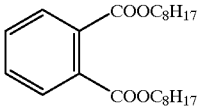
Oil-2
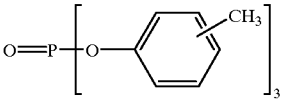
Oil-3
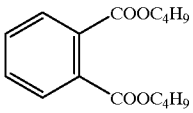

-continued
SC-1
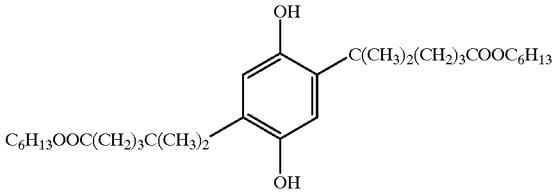
SD-1
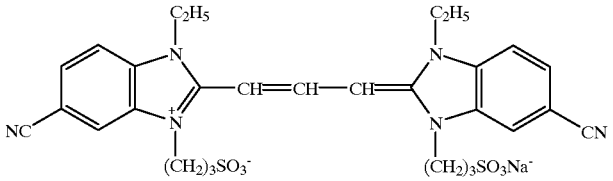
SD-2
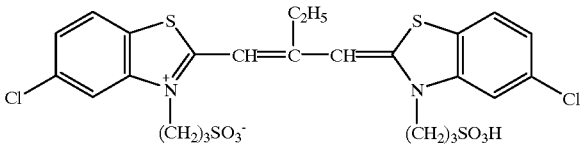
SD-3
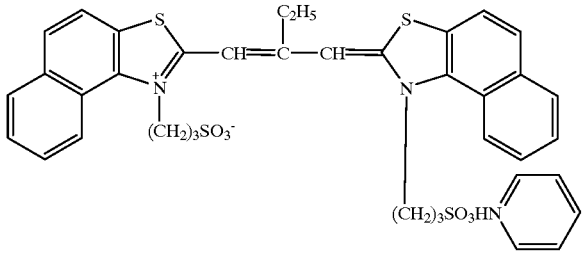
SD-4
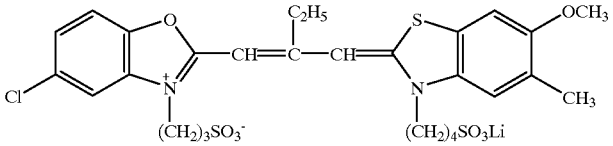
SD-5
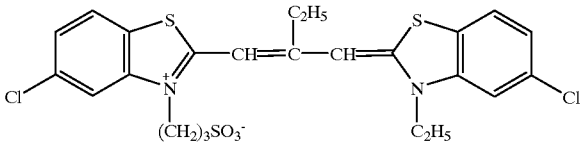
SD-6
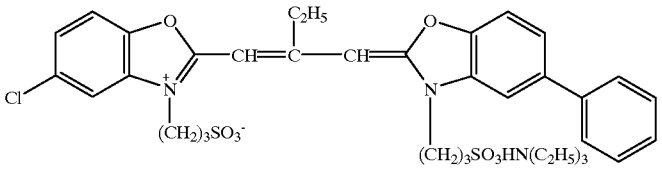
SD-7
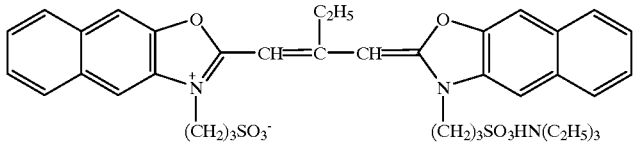

-continued
SD-8
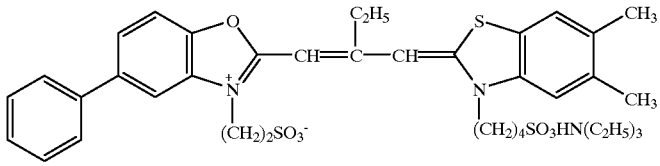
SD-9
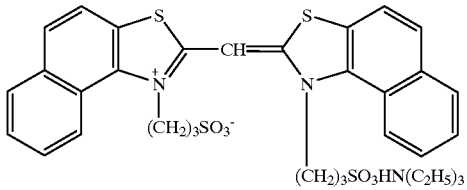
SD-10
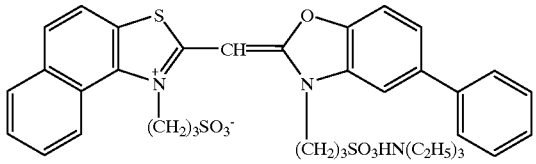
SD-11
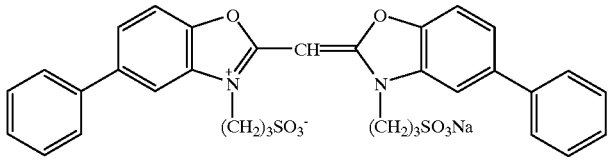
SD-12
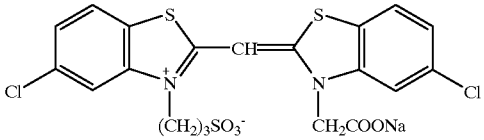
SD-13
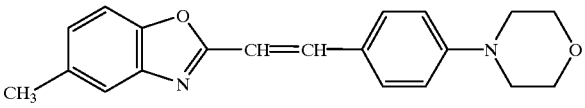
-continued
UV absorbent
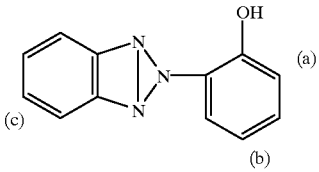
| | (a) | (b) | (c) |
|---|---|---|---|
| UV-1 | —$C_{12}H_{25}$ | —$CH_3$ | —H |
| UV-2 | —H | —(t)$C_4H_9$ | —H |
| UV-3 | —(t)$C_4H_9$ | —(t)$C_4H_9$ | —H |
| UV-4 | —(t)$C_4H_9$ | —$CH_3$ | —Cl |
| UV-5 | —(t)$C_4H_9$ | —(t)$C_4H_9$ | —Cl |
-continued
UV absorbent
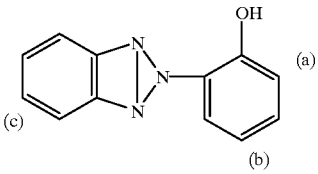
| | (a) | (b) | (c) |
|---|---|---|---|
| UV-6 | 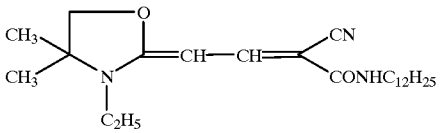 | | |

WAX-1

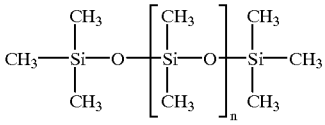

Weight-averaged moleclar weight: 3,000

SU-1

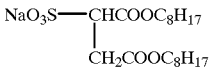

SU-2

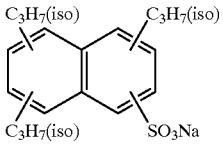

SU-3

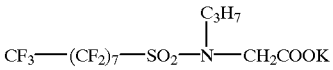

SU-4

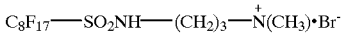

FS-1

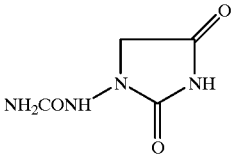

FS-2

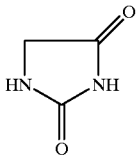

H-1

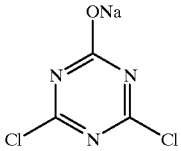

H-2

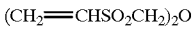

ST-1

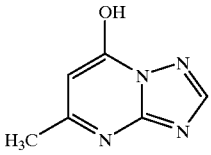

AF-1

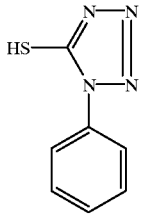

AF-2

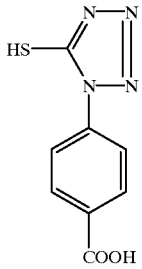

AF-3

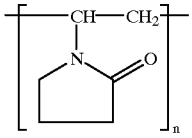

Weight-averaged molecular weight: 10,000
Weight-averaged molecular weight: 1,100,000

DI-1 (Mixture)

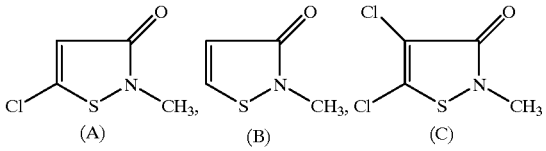

A:B:C = 50:46:4(Molar ratio)

Emulsions used in the above sample are as follows, in which an average grain size is represented as calculated in terms of a cubic grain. Each of the emulsions was optimally subjected to gold-sulfur-selenium sensitization.

| Emulsion | Av. AgI content (mol %) | Av. grain size (μm) | Crystal habit | Diameter/thickness ratio |
|---|---|---|---|---|
| A | 2.0 | 0.32 | Regular* | 1.0 |
| B | 6.0 | 0.42 | Twinned tabular* | 4.0 |
| D | 8.0 | 0.70 | Twinned tabular | 5.0 |

-continued

| Emulsion | Av. AgI content (mol %) | Av. grain size (μm) | Crystal habit | Diameter/thickness ratio |
|---|---|---|---|---|
| E | 6.0 | 0.60 | Twinned tabular | 4.0 |
| F | 2.0 | 0.42 | Twinned tabular | 4.0 |
| G | 8.0 | 0.90 | Twinned tabular | 3.0 |

*Regular: Regular crystal
Twinned tabular: Twinned tabular Crystal

Silver iodobromide emulsions A, B, and F each contain iridium of $1\times10^{-7}$ mol/ mol Ag.

Samples 102 to 110 were prepared in the same manner as Sample 101, except that an invisible light-sensitive layer or non-emulsion layer (light insensitive layer) of A-layer to E-layer as shown below was provided between the 1st and 3rd layers.

| | |
|---|---|
| A-Layer; Coupler Containing Invisible Light-sensitive Layer | |
| Silver iodobromide emulsion E | 0.15 |
| Silver iodobromide emulsion G | 0.70 |
| Sensitizing dye (1-10) | $2.0 \times 10^{-4}$ |
| Magenta coupler (M-1) | 0.20 |
| High boiling solvent (Oil-1) | 0.34 |
| Gelatin | 0.90 |
| B-Layer; Interlayer Effect having, Invisible Light-sensitive Layer | |
| Silver iodobromide emulsion E | 0.15 |
| Silver iodobromide emulsion G | 0.70 |
| Sensitizing dye (5-1) | $2.0 \times 10^{-4}$ |
| DIR compound (D-1) | 0.20 |
| High boiling solvent (Oil-1) | 0.07 |
| Gelatin | 0.90 |
| C-Layer; Interlayer Effect having, Invisible Light-sensitive Layer | |
| Silver iodobromide emulsion E | 0.15 |
| Silver iodobromide emulsion G | 0.70 |
| Sensitizing dye (5-1) | $2.0 \times 10^{-4}$ |
| Colored cyan coupler (CC-1) | 0.20 |
| High boiling solvent (Oil-1) | 0.07 |
| Gelatin | 0.90 |
| D-Layer | |
| High boiling solvent (Oil-1) | 0.01 |
| Gelatin | 1.27 |
| E-Layer | |
| DIR compound (D-1) | 0.20 |
| High boiling solvent (Oil-1) | 0.07 |
| Gelatin | 0.90 |
| F-Layer | |
| Colored cyan coupler (CC-1) | 0.20 |
| High boiling solvent (Oil-1) | 0.07 |
| Gelatin | 0.90 |

TABLE 1

| Sample | Layer Arrangement | | | | | Remark |
|---|---|---|---|---|---|---|
| 101 | 1st layer | 2nd layer | | | 3rd layer | Comp. |
| 102 | 1st layer | 2nd layer | A-layer | D-layer | 3rd layer | Comp. |

TABLE 1-continued

| Sample | Layer Arrangement | | | | | | | Remark |
|---|---|---|---|---|---|---|---|---|
| 103 | 1st layer | 2nd layer | A-layer | B-layer | D-layer | 3rd layer | | Inv. |
| 104 | 1st layer | 2nd layer | A-layer | C-layer | D-layer | 3rd layer | | Inv. |
| 105 | 1st layer | 2nd layer | A-layer | B-layer | E-layer | 3rd layer | | Inv. |
| 106 | 1st layer | 2nd layer | A-layer | C-layer | E-layer | 3rd layer | | Inv. |
| 107 | 1st layer | 2nd layer | A-layer | | E-layer | 3rd layer | | Inv. |
| 108 | 1st layer | 2nd layer | A-layer | | F-layer | 3rd layer | | Inv. |
| 109 | 1st layer | 2nd layer | A-layer | B-layer | | 3rd layer | | Inv. |
| 110 | 1st layer | 2nd layer | A-layer | C-layer | | 3rd layer | | Inv. |

In the Table, for example, Sample 101 has no layer between the 2nd layer and the 3rd layer, and Sample 102 has A-layer and D-layer, which are adjacent with each other, between 2nd and 3rd layers.

Determination of Sensitivity Maximum of Infrared Sensitive Layer

To the infrared sensitive layer of Samples 103, 104, 105, 106, 107, 108, 109 and 110 was added a yellow coupler, Y-2 of 0.12 g/m$^2$, and the thus obtained samples were each exposed to spectral light of 570 to 750 nm at 5-nm intervals and subjected to color processing (employing CNK-4, available from Konica Corp.). From each of the processed samples was obtained a spectral sensitivity curve of the red-sensitive donor layer and of the infrared-sensitivity layer that gave a blue density of a minimum density plus 0.3. From the obtained spectral sensitivity curve was determined the wavelength of the sensitivity maximum (λ max) of the red-sensitive or infrared-sensitive donor layer. Spectral sensitivity distribution of each layer is shown in Table 2.

TABLE 2

| | Layer | $\lambda_{max}$ | $\lambda_{-20}$* | $\lambda_{+20}$* |
|---|---|---|---|---|
| 3rd Layer | Low speed red-sensitive layer | 640 | 590 | 660 |
| 4th Layer | Medium speed red-sensitive layer | 640 | 595 | 655 |
| 5th Layer | High speed red-sensitive layer | 640 | 595 | 655 |
| 8th Layer | Low speed green-sensitive layer | 560 | 520 | 580 |
| 9th Layer | Medium speed green-sensitive layer | 560 | 530 | 580 |
| 10th Layer | High speed green-sensitive layer | 560 | 530 | 580 |
| 14th Layer | Low speed blue-sensitive layer | 440 | 410 | 480 |
| 15th Layer | Medium speed blue-sensitive layer | 430 | 405 | 480 |
| 16th Layer | High speed blue-sensitive layer | 420 | 395 | 480 |
| A-Layer | | 750 | 720 | 800 |
| B-Layer | | 700 | 680 | 715 |
| C-Layer | | 700 | 680 | 715 |

*: $\lambda_{-20}$ indicates the wavelength of sensitivity exhibiting 20% of the sensitivity maximum at the shorter wavelength side, and $\lambda_{+20}$ indicates the wavelength of sensitivity exhibiting 20% of the sensitivity maximum at the longer wavelength.

It was proved that the invisible light-sensitive layer of each of Samples 103, 104, 105, 106, 107, 108, 109 and 110 had a sensitivity maximum at the wavelengths of 680 to 720 nm.

A-, B- and C-layers of samples according to this invention each had the same spectral sensitivity irrespective of their position.

These samples were each cut according to the 135-Standard, put into a patrone, loaded into a camera (Konica Hexer, available from Konica Corp.), and photographs were taken in a studio using strobes (produced by Comet Corp.), including red tulips and their leaves, and a Macbeth chart. Photographed samples were processed (employing CNK-4, available from Konica Corp.) and dried to obtain film samples. The thus picture-taken and processed samples each were printed on color paper (Konica Color Paper Type QAA3), using a Chromega enlarger, by adjusting color balance so that gray color having 18% reflectance was reproduced as gray color; and then subjected to color paper processing (employing CPK-2-21 available from Konica Corp.). Further, the prints were sensorily assessed by 20 observers with respect to reproduction of the Macbeth chart, red flowers and green leaves, based on ten steps with 1-point (poor) to 10-points (superior), and the average point was shown in Table 4 with the proviso that the point of Sample 101 be 5.

TABLE 3

| Sample | Reproduction of Macbeth chart | Reproduction of red flowers | Reproduction of green leaves |
|---|---|---|---|
| 101 (Comp.) | 5 | 5 | 5 |
| 102 (Comp.) | 6.15 | 4.80 | 7.85 |
| 103 (Inv.) | 8.05 | 8.85 | 9.10 |
| 104 (Inv.) | 7.85 | 7.90 | 8.90 |
| 105 (Inv.) | 9.05 | 9.10 | 9.70 |
| 106 (Inv.) | 9.00 | 8.45 | 9.60 |
| 107 (Inv.) | 6.15 | 6.75 | 8.05 |
| 108 (Inv.) | 5.90 | 6.05 | 8.00 |
| 109 (Inv.) | 7.10 | 8.05 | 9.00 |
| 110 (Inv.) | 6.90 | 7.25 | 8.85 |

As can be seen from Table 3, inventive Sample 103 to 110 exhibited superior color reproduction, in which color reproduction of green leaves and that of red flowers were consistent with each other. Color reproduction of the Macbeth chart was also superior. Thus, inventive samples exhibited enhanced color reproduction as well as its stability.

What is claimed is:

1. A silver halide light sensitive color photographic material comprising a support having on one side thereof a blue-sensitive silver halide emulsion layer containing a yellow coupler, a green-sensitive silver halide emulsion layer containing a magenta coupler, a red-sensitive silver halide emulsion layer containing a cyan coupler, an invisible light-sensitive silver halide emulsion layer containing a coupler and a layer having an interlayer effect.

2. The silver halide color photographic material of claim 1, wherein said layer having an interlayer effect contains a compound selected from the group consisting of a DIR compound and a colored coupler.

3. The silver halide color photographic material of claim 1, wherein said layer having an interlayer effect is an invisible light-sensitive silver halide emulsion layer.

4. The silver halide color photographic material of claim 3, wherein said invisible-light sensitive silver halide emulsion layer having an interlayer effect has a spectral sensitivity different from the invisible light-sensitive silver halide emulsion layer containing a coupler.

5. The silver halide color photographic material of claim 1, wherein said layer having an interlayer effect is light-insensitive.

6. The silver halide color photographic material of claim 1, wherein said layer having an interlayer effect has its interlayer effect on at least one of the invisible light-sensitive silver halide emulsion layer containing a coupler and the red-sensitive silver halide emulsion layer.

7. The silver halide color photographic material of claim 1, wherein said layer having an interlayer effect is between the red-sensitive silver halide emulsion layer and the invisible light-sensitive silver halide emulsion layer.

8. The silver halide color photographic material of claim 7, wherein said layer having an interlayer effect is adjacent to the red-sensitive silver halide emulsion layer and the invisible light-sensitive silver halide emulsion layer.

9. The silver halide color photographic material of claim 1, wherein said invisible light-sensitive silver halide emulsion layer is an infrared-sensitive silver halide emulsion layer.

* * * * *